United States Patent [19]

McMullen et al.

[11] Patent Number: 4,705,603

[45] Date of Patent: Nov. 10, 1987

[54] PYROLYTIC APPARATUS

[76] Inventors: Roger B. McMullen; Dillon G. McMullen; Frederick G. McMullen, all of P.O. Box 396, Gwynedd Valley, Pa. 19437

[21] Appl. No.: 848,968

[22] Filed: Apr. 7, 1986

[51] Int. Cl.[4] ..... C10B 1/06

[52] U.S. Cl. ..... 202/109; 202/112; 202/118; 202/138; 202/220

[58] Field of Search ..... 202/105, 109, 110, 112, 202/117, 118, 133, 137, 138, 265, 217, 220; 201/2.5, 25, 33, 34, 35; 48/89, 99, 101, 111, 119, 197 A; 110/222, 224, 227–229; 432/155, 212; 34/183; 422/202, 204, 206, 233

[56] References Cited

U.S. PATENT DOCUMENTS

| | | | |
|---|---|---|---|
| 112,557 | 3/1871 | Davison | 202/112 |
| 2,640,805 | 6/1953 | Hughes | 202/112 |
| 3,481,720 | 12/1969 | Bennett | 48/89 |
| 4,123,332 | 10/1978 | Rotter | 202/117 |
| 4,217,175 | 8/1980 | Reilly | 202/118 |

FOREIGN PATENT DOCUMENTS

| | | | |
|---|---|---|---|
| 972449 | 1/1951 | France | 34/183 |
| 129771 | 7/1919 | United Kingdom | 201/32 |

*Primary Examiner*—Barry S. Richman
*Assistant Examiner*—Joye L. Woodard
*Attorney, Agent, or Firm*—Anthony F. Cuoco

[57] ABSTRACT

Pyrolytic apparatus for the rapid and efficient thermal dissociation of matter is disclosed. The apparatus includes a concentric tubular arrangement of high thermal conductivity in a heat sink configuration; inlet members for heat and feedstock; outlet members for solids, gases and heat exhaust; and a plurality of annular passages through which heat is brought into heat transfer relationship with an interior pyrolytic retort section for the dissociation of matter conveyed therein into solid, liquid and gaseous by-products. Provisions are made for the separate liberation of steam produced by the simultaneous interfacing of superheated steam and product gas during pyrolytic decomposition of high moisture content feedstocks. Additional hydrocarbons from the product gas evoluted in the pyrolytic retort section are provided by diversion of the gas to an annulus flanked on either side by adjacent annuli conveying the heat source supply to exit. Residual carbon, the by-product of the dissociation, is continuously expelled from the pyrolytic retort section of the apparatus.

6 Claims, 2 Drawing Figures

PYROLYTIC APPARATUS

BACKGROUND OF THE INVENTION

This invention relates to pyrolytic apparatus for the thermal conversion of organic waste, waste water sludge and/or other organic and/or inorganic matter into useable solid or gaseous by-products.

Pyrolysis is defined as the chemical decomposition of matter while in an oxygen deficient, high temperature atmosphere. That is to say, the matter is not oxidized, but is rapidly decomposed to a fixed carbon state by the application of external heat while confined in an air-tight retort or the like.

While the principles of pyrolysis are well-known and practiced, prior art apparatus for accomplishing pyrolysis has provided less than desired results in terms of economy, versatility and efficiency; has not strictly adhered to pyrolytic principles; and has been relatively complex in construction.

The present invention overcomes these disadvantages by providing pyrolytic apparatus for the rapid and efficient thermal dissociation of a variety of feedstocks into energy while strictly adhering to the principles of pyrolysis. The apparatus is simplified in construction; has the additional advantage of being self-sustaining; and may be used to pre-dry the feedstocks. Additionally, the pyrolytic by-products may be easily recovered, stored and otherwise used as may be desired.

While the invention has a particular application in converting solid wastes and wastewater sludge into energy and marketable by-products, it may also be used for other purposes such as, for example, the continuous dissociation of wood wastes, paper mill sludge and peat into high quality gaseous fuels and carbon.

SUMMARY OF THE INVENTION

This invention contemplates pyrolytic apparatus for converting solid waste, wastewater sludge and/or solid organic or inorganic matter (feedstock) into energy and marketable by-products. The invention is configured as a heat sink, whereby heat from a heat source is used to dissociate the feedstock and to crack the resultant gaseous product, while the temperature of the apparatus increases above that of the heat source. The gaseous product may be reused to provide energy self-sufficiency, thereby eliminating the need for an external heat source.

In accordance with the invention, raw feedstock enters one end of the pyrolytic apparatus and is conveyed via an auger to the opposite end where it exits the apparatus while dissociating to a gaseous state and residual char. While the residual char has further utility outside of the invention, the gaseous product is retained and ducted between high heat annuli for cracking to create additional hydrocarbons. The annuli are arranged to form the aforenoted heat sink, which is enhanced by the internal exothermic reaction at the moment of flash pyrolysis of the feedstock. The arrangement is such that the raw feedstock causes an absorption (endothermic reaction) of heat until the moment of flash pyrolysis.

DETAILED DESCRIPTION OF THE INVENTION

The pyrolytic apparatus herein described achieves continuous dissociation of feedstock in an oxygen deficient atmosphere at a pressure such as, for purposes of example, one atmosphere and at relatively high temperatures such as, for purposes of example, 1,300 to 1,600 degrees F. The apparatus acts as its own heat sink, simultaneously recovering its own waste heat during dissociation of the feedstock. While evoluting a combustible gas, the gas is further cracked to thereby increase the number of hydrocarbon molecules therein.

Figure 2:
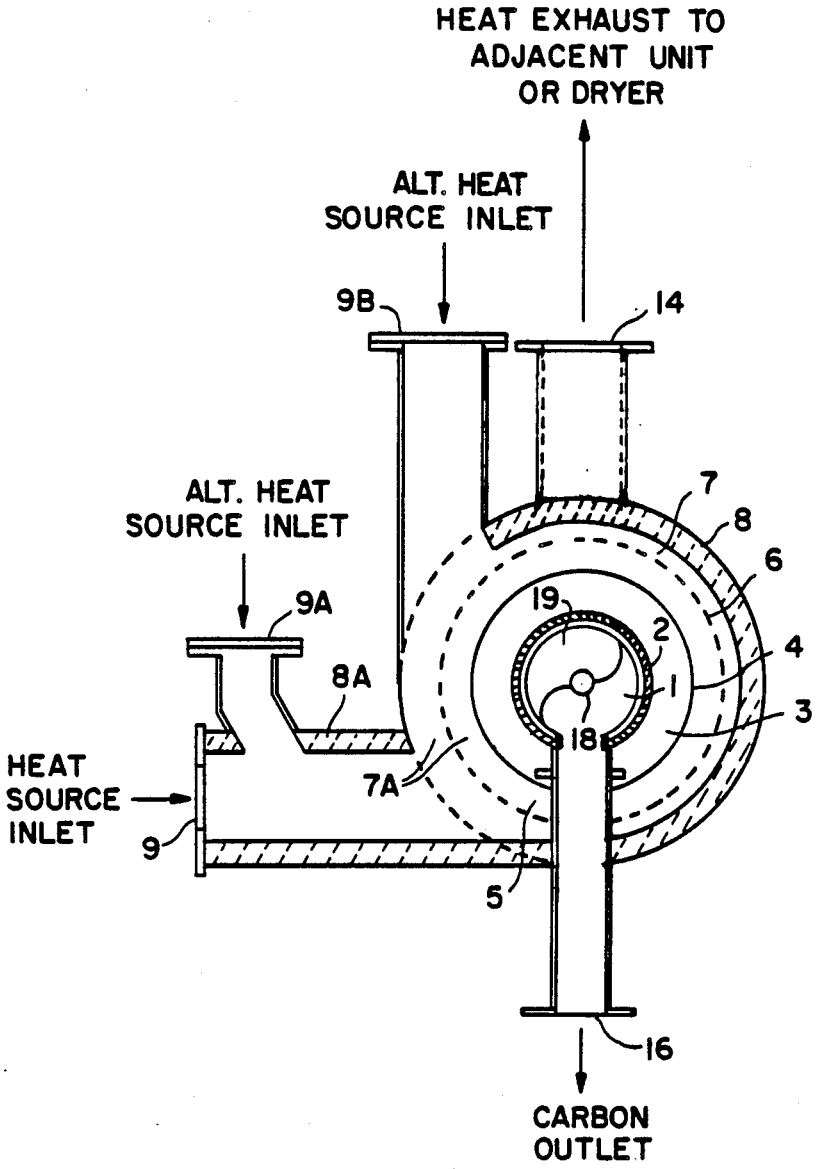
FIG. 2 is an end view, partially sectioned diagrammatic representation of the apparatus.

With reference to the drawing, the apparatus of the invention includes four longitudinally extending, concentric tubes of increasing diameter and designated by the numerals 2, 4, 6, and 8. Heated gas flows continuously within the concentric annuli formed by the tubes and designated by the numerals 1, 3, 5, and 7 to effect a heat transfer relationship within an internal pyrolytic retort section of the invention. Tubes 2, 4, 6, and 8 are of a corrosion resistant, thermally conductive material such as a suitable grade stainless steel or the equivalent. A heat inlet end of the apparatus is configured as a replaceable plenum chamber 7A having, for example, a castable refractory lining 8A as shown in FIG. 2.

Thus, annulus 1 forms the pyrolytic retort section of the apparatus. Annulus 3 which is a heat source supply annulus surrounds annulus 1; annulus 5 which is a pyrolytic gas annulus surrounds annulus 3; and annulus 7 which is a heat exhaust annulus surrounds annulus 5. The ends of annuli 1, 3, 5, and 7 are sealed as by members 11 shown in FIG. 1 to prevent the escape of heat or gases as will now be understood.

A feedstock inlet member 10 communicates with annulus 1. A pyrolytic gas outlet member 12 communicates with annulus 5 and a heat source exhaust member 14 communicates with annulus 7. As best shown in FIG. 2, a heat source inlet member 9 communicates via plenum chamber 7A with annulus 3 and a carbon outlet member 16 communicates with annulus 1. In regard to heat source inlet member 9, in the preferred embodiment of the invention said member is disposed at the end of the apparatus opposite the end where feedstock inlet member 10 is disposed. Alternate heat sources 9A and 9B likewise communicate with annulus 3 via plenum chamber 7A.

Figure 1:
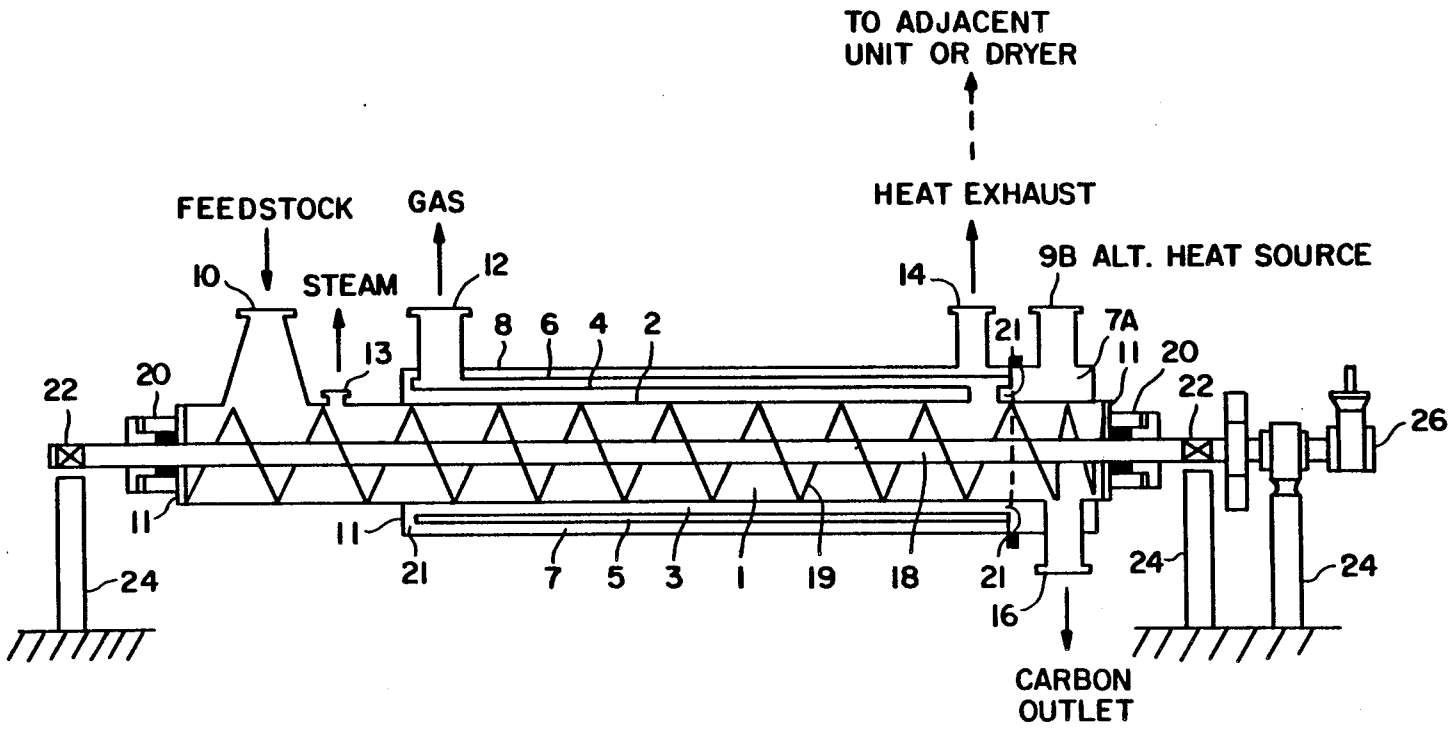
FIG. 1 is a plan view diagrammatic representation showing the internal structure of the pyrolytic apparatus of the invention.

Feedstock enters the apparatus via feedstock inlet member 10 and is propelled from one end of the apparatus to the other by a conventional auger including a drive shaft 18 and an impeller 19 disposed in annulus 1. With particular reference to FIG. 1, shaft 18 is supported via conventional stuffing boxes 20 at both ends thereof, and journaled via journals 22 in suitable support members 24. Auger shaft 18 is driven by a suitable drive 26 which is of the variable speed type.

In operation, feedstock entering the high temperature of pyrolytic section (annulus 1) of the apparatus through feedstock inlet member 10 at its charging end is augered through the apparatus by impeller 19. Depending upon temperature and augering time, the feedstock may be exposed to a variety of processes such as, for example, drying, cooking, smelting or charring, as the case may be.

The basic function of the invention is to produce a clean, high calorific value combustible gas achieved by flash pyrolysis of the feedstock, and resulting in a minimal amount of residual carbon from annulus 1, which is the high heat (pyrolytic) zone annulus, and heat source annulus 3. Heat flux, upon leaving annulus 3, which surrounds annulus 1, is then conducted through annulus 7 which surrounds annulus 5.

The arrangement is such that the center core feedstock increases in temperature endothermically until dissociating into a gas which increases in temperature at the moment it changes from an endothermic to an exothermic state (flash pyrolysis) and leaves a carbon residue which may be removed via member 16.

The pyrolytic product gas then evolutes back through annulus 5, but in an opposite direction, being sandwiched between annuli 3 and 7. The product gas thereby completing its return path to the point of feedstock entry, exits via gas outlet member 12 and may be retrieved or otherwise stored for further use. In this connection it will be noted that the several annuli are interconnected as by apertures such as 21 shown in FIG. 1, whereby gas and heat flux flow through said annuli as aforenoted.

It will thus be seen that the apparatus herein described takes full advantage of the principles of time, temperature and turbulence to achieve the desired results. Time and turbulence are controlled during feedstock conveyance by varying the speed of auger drive shaft 18. Temperature is controlled first by heat from an outside heat source, which may be of a conventional nature, entering the apparatus through heat source inlet member 9 (FIG. 2), or alternate heat sources 9A, 9B, as the case may be, and then by monitoring devices (not shown) which regulate the back pressure within the device. Hence, the entire apparatus becomes its own heat sink with the temperature therein increasing and being regulated by the feedstock flow.

It will be understood that the intent of the invention is not to limit it to a single pass high heat zone. The principles involved allow for pre-drying the feedstock and/or providing superheated steam if so desired. In this later event steam produced by interfacing of the superheated steam and pyrolytic product gas is removed from the apparatus via a steam outlet member 13 (FIG. 1) communicating with annulus 1.

In regard to predrying the feedstock prior to pyrolysis, this is accomplished simply by utilizing the remaining heat after attaining thermal-equilibrium within the apparatus.

The apparatus as shown and described with reference to FIGS. 1 and 2 may be repeated in design to provide a plurality of adjacent units each of which is arranged so that one unit functions off the waste heat from another unit as taken from heat source outlet member 14 as indicated in FIG. 1, or if necessary with a supplemental heat source. In regard to the drying process it will be understood that the drying temperatures need not be as high as the temperatures for flash pyrolysis.

In regard to the aforenoted heat sink affect, this is achieved by both the heat given off at the moment of exothermic reaction and the endothermic absorption of heat in the feedstock, while back pressure caused by the restriction of the product gas and source heat flux adds a dwell time and a more normal angle of heat flux to the internal surface areas of the apparatus.

With the aforegoing description of the invention in mind reference is had to the claims appended hereto for a definition of the scope of the invention.

What is claimed is:

1. Pyrolytic apparatus for pyrolyzing a carbonaceous feedstock, comprising:

a plurality of tubes formed of a material a high thermal conductivity for providing a heat sink and concentrically arranged to provide a plurality of longitudinally extending annular passages;

sealing members extending between the ends of adjacent tubes for enclosing each of the plurality of annular passages; the innermost tube defining a first of said passages for pyrolyzing a carbonaceous feedstock to produce a gaseous pyrolytic product and a solid pyrolytic residue;

a feedstock inlet member connected to an upstream end of the first passage for introducing a carbonaceous feedstock thereto;

means disposed within the first passage for conveying the feedstock therein from said upstream end to a downstream end;

a residue outlet member connected to the downstream end of the first passage for removing the solid pyrolytic residue therefrom;

a second of said annular passages surrounding the first passage, and means for supplying a heat carrier to the second passage;

a third of said annular passages surrounding the second passage, means connecting the first passage with the third passage and a product gas outlet member connected to the third passage thereby forming an outlet passage for the gaseous pyrolytic product; and a fourth of said passages surrounding the third passage, means connecting the second passage with the fourth passage and a heat carrier exhaust member connected to the fourth passage thereby forming an exhaust passage for the heat carrier, wherein said feedstock is pyrolyzed in the first passage by heat transfer from the heat carrier supplied to the second passage and the gaseous pyrolytic product is cracked in the third passage by heat transfer from the heat carrier supplied to the second passage and from the heat carrier exhausted from the fourth passage.

2. Apparatus as described by claim 1, including:

a replaceable plenum chamber having a refractory lining;

said heat carrier supply connected to the plenum chamber; and said plenum chamber connected to the downstream end of the second passage for supplying the heat carrier thereto countercurrent to the direction of feedstock conveyance through the first passage.

3. Apparatus as described by claim 2, including:

said means connecting the first passage with the third passage connects the downstream ends thereof and the product gas outlet member is connected to the upstream end of the third passage; and said means connecting the second passage with the fourth passage connects the upstream ends thereof and the heat carrier exhaust member is connected to the downstream end of the fourth passage, whereby the gaseous pyrolytic product outlet flow through the third passage is concurrent with the heat carrier flow through the second passage and countercurrent with the exhaust flow of the heat carrier through the fourth passage.

4. Apparatus as described by claim 1, wherein:

the feedstock has a moisture content so that the pyrolysis thereof initially produces a gaseous stream comprised mainly of steam; and a steam outlet member connnected to the upstream end of the first passage for removing said stream.

5. Apparatus as described by claim 1, wherein the means disposed within the first passage for conveying feedstock therein from one end thereof to the other includes:

augering means extending longitudinally within the first passage; and drive means coupled to the augering means for driving said means, whereby the feedstock is conveyed through the first passage.

6. Apparatus as described by claim 5, wherein the drive means includes:

varible speed means for varying the speed at which the feedstock is conveyed through the first passage, with the turbulence of the conveyed feedstock being commensurate with the conveying speed.

* * * * *